US006669290B1

(12) United States Patent
Pugh

(10) Patent No.: US 6,669,290 B1
(45) Date of Patent: Dec. 30, 2003

(54) HORIZONTAL GLIDING CHAIR

(76) Inventor: Gary W. Pugh, 36 Rickhaven, Collinsville, IL (US) 56220

( * ) Notice: Subject to any disclaimer, the term of this patent is extended or adjusted under 35 U.S.C. 154(b) by 0 days.

(21) Appl. No.: 10/213,375

(22) Filed: Aug. 7, 2002

(51) Int. Cl.[7] ..... A47C 3/02

(52) U.S. Cl. ..... 297/259.3; 297/271.6; 297/259.1

(58) Field of Search ..... 297/259.1, 259.3, 297/271.5, 271.6, 272.1, 258.1

(56) References Cited

U.S. PATENT DOCUMENTS 892,937 A * 7/1908 Cowles et al.
1,011,728 A * 12/1911 Boyd
1,579,085 A * 3/1926 Cotner
2,363,333 A * 11/1944 Johnson
D254,942 S 5/1980 Browning
4,796,949 A 1/1989 Boyce
5,246,268 A * 9/1993 Lerner et al.
5,765,913 A 6/1998 LaPointe et al.

* cited by examiner

*Primary Examiner*—Laurie K. Cranmer
(74) *Attorney, Agent, or Firm*—Don W. Weber

(57) ABSTRACT

A horizontal gliding chair has a flat seat and a seat back located at an angle of approximately 75 degrees to the seat back. Connected to the seat are four symmetrically placed brackets that are connected to four shoulders. The shoulders pivot slightly within the seat brackets. Four symmetrically placed arcuate rocking members are connected to the shoulders, respectively, by legs. The front right and left rocker feet are connected to each other. The rear left and right connecting feet are connected to each other. The front and rear rocker feet are also pivotably connected to each other by a brace connector. The base of the seat back is located in front of the rear brace pivot hole. The chair seat moves in a horizontal front and back direction. During this motion, the cooperation between the rocker feet, braces and rocker connector allows the seat to travel forward or backward in a smooth, horizontal motion.

3 Claims, 2 Drawing Sheets

FIG. 1
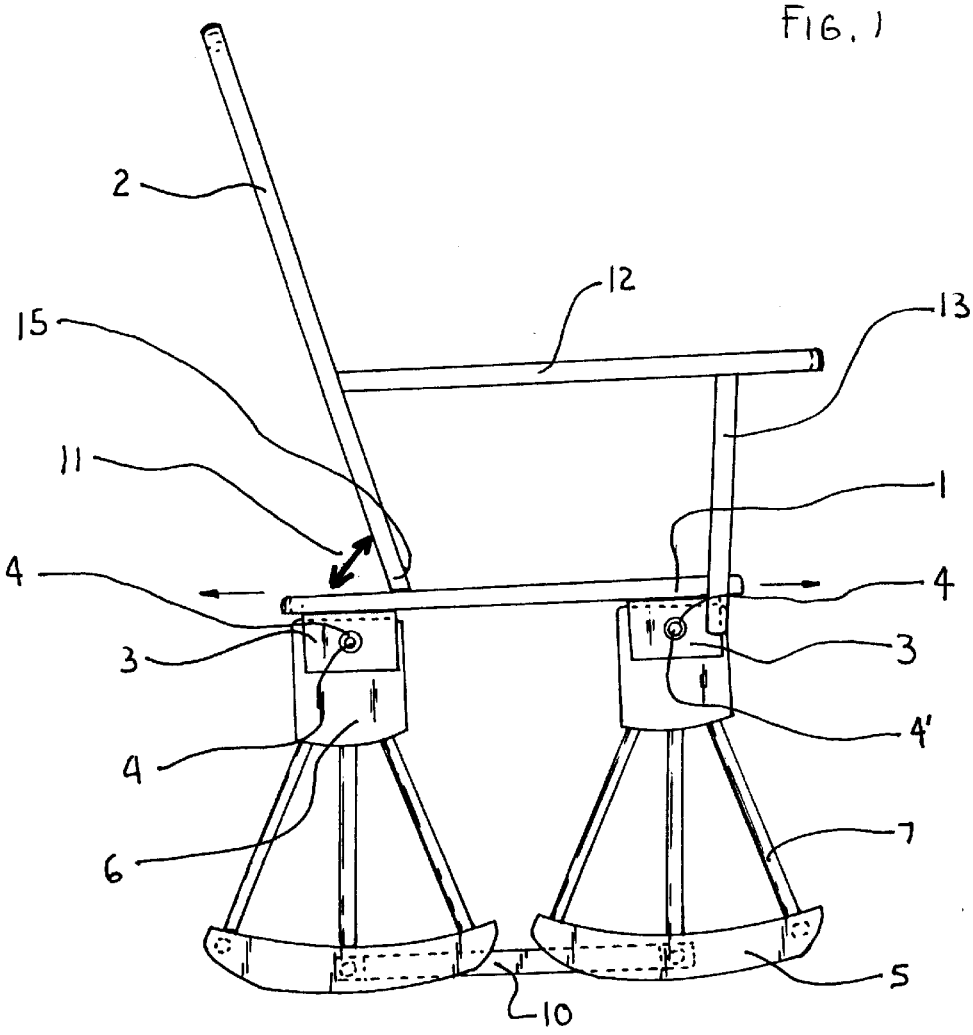
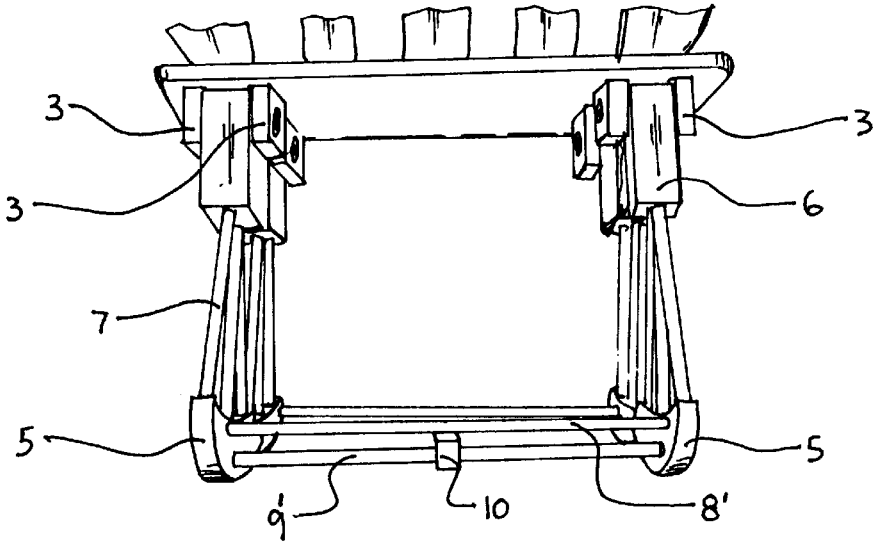
FIG. 2

FIG. 3
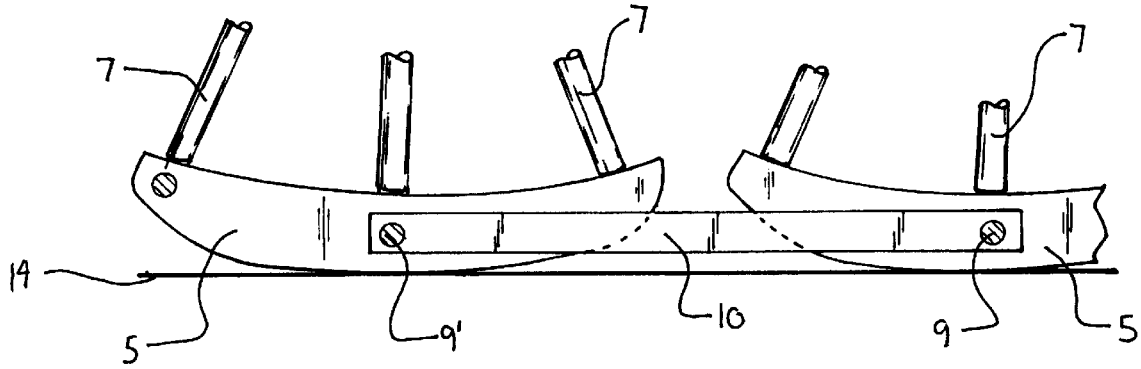
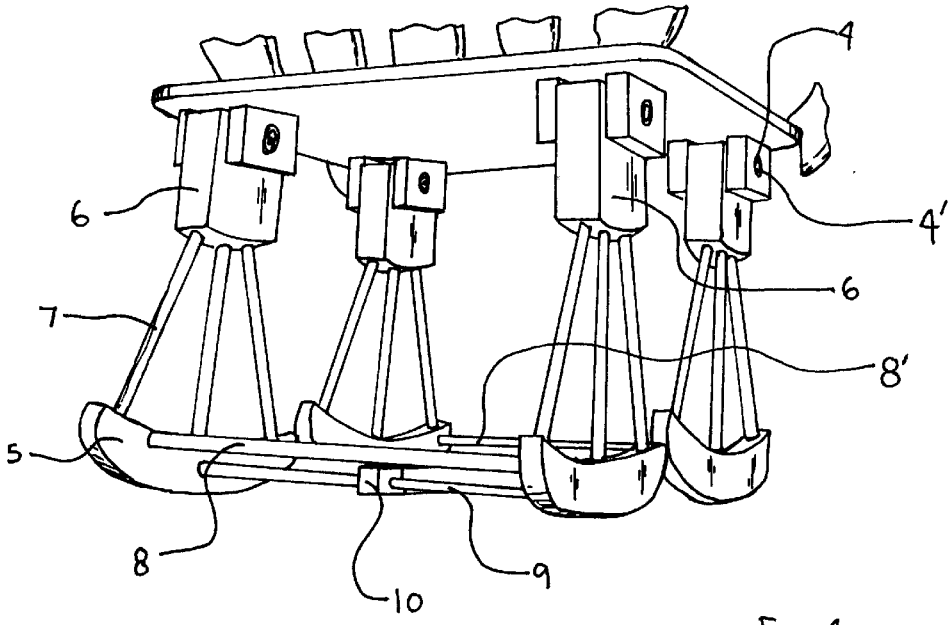
FIG. 4

HORIZONTAL GLIDING CHAIR

BACKGROUND OF THE INVENTION

This invention relates to the field of furniture. More particularly, a glider chair is presented which allows a chair to achieve smooth, horizontal forward gliding motion.

Rocking chairs have been known in the art for hundreds of years. The simplest of rocking chairs includes a chair seat, essentially perpendicular back, legs and curved or arcuate rocking chair feet. The chair rocks back and forth by a simple movement of the occupant's legs.

Another type of chair is a glider chair. The glider chair has a seat and back connected to a base mechanism such that the seat and back move back and forth in an essentially parallel line. The glider chair is connected to a stationary base by pivoting arms which keep the base seat essentially parallel to the ground as it moves forward and backward. Glider chairs are common throughout the art and are frequently used as outdoor furniture or porch furniture. One example of a recently patented glider chair is the 1998 U.S. Pat. No. 5,765,913 issued to LaPointe. This glider chair included an improved glider linkage that had front and back glide links laterally preloaded so that non-precision bearing may be utilized. The chair is surrounded by a rigid box like frame mechanism so that the extended glide links provide a smooth and relatively flat glide motion.

Normal chairs are frequently utilized for various purposes. For example, a chair may be used to sit and to watch television. It may also be used at a table for dining. However, a gliding chair would not normally be useful as a dining chair, since the stationary base of the glider would not allow the chair to be moved up close enough to the table to provide a comfortable chair. It is an object of this invention to provide a glider chair that may be placed in a position near a table such that the seat may be moved forwardly while still keeping parallel to the floor, and while the base moves somewhat forward as it moves on its rocker feet.

Other and further objects of this invention will become obvious upon reading the below described Specification.

BRIEF DESCRIPTION OF THE PREFERRED EMBODIMENT

A gliding chair is presented which has an essentially horizontal seat with a slanted back. The chair is attached to four symmetrical arcuate feet by means of chair legs. The front left and right arcuate feet are connected together by cross braces. Similarly, the rear left and right arcuate feet are also connected together by cross braces. The front and rear set of arcuate rocker feet are then connected by a glider brace connector. With the forward placement of the back seat on the seat base, and a degree of tilt between 70 and 80 degrees, the chair has almost no rocking motion as it moves forward. Rather the chair seat remains nearly horizontal to the floor as the seat is moved forward or backward.

BRIEF DESCRIPTION OF THE DRAWINGS

FIG. 1 is a side view of the horizontal gliding chair.

FIG. 2 is a partial front perspective view of the rear of the lower section of the chair.

FIG. 3 is a side partial view of the rockers and legs on a surface.

FIG. 4 is a perspective view of the lower portion of the chair taken from the front of the chair.

DETAILED DESCRIPTION OF THE PREFERRED EMBODIMENT

A horizontal gliding chair is best shown in FIG. 1. The chair consists of an essentially horizontal seat 1 and a chair back 2. The acute angle 11 between the chair seat 1 and chair back 2 is 75 degrees in the preferred embodiment. It may vary between 70 and 80 degrees; however, the 75 degree angle is preferred.

The lower seat has lower chair seat brackets 3. The brackets are arranged in pairs as shown. These seat brackets 3 are arranged symmetrically and attached to the lower surface of the chair seat 1 by gluing or by other standard attaching means. There are four pairs of lower chair seat brackets 3 as best shown in Drawing FIGS. 2 and 4. These pairs include front left and right seat brackets and rear left and right seat brackets. Each pair of seat brackets has a central hole 4, used to pivotably connect each pair of seat brackets to a chair shoulder 6.

The chair also comprises front left and right and rear left and right shoulders 6. A shoulder 6 is connected between a pair of seat brackets 3, by a pivot pin 4'. The pivotable connection between the lower chair seat brackets 3 and the chair shoulder 6 is best shown in FIGS. 2 and 4. There is a small space (less than ½ of an inch) between the top of the shoulder 6 and the bottom of the chair seat 1, as best shown in FIG. 4. The front left and right shoulders 6 and the rear left and right shoulders 6 are symmetrically arranged as shown and are all connected in the same manner. Each shoulder 6 has a corresponding pair of brackets 3, as best shown in Drawing FIG. 4.

The horizontal gliding chair also has four arc-shaped rocker feet 5, as shown in the Drawing Figures. Each shoulder 6 has a corresponding rocker foot 5 connected to it by means of chair legs 7. The chair has four symmetrically located rocker feet. The chair has front left and right rocker feet and rear left and right rocker feet. The front left and right and rear left and right rocker feet are connected to the four shoulders, respectively.

The shoulders 6 and rocker feet 5 are connected to each other by a plurality of chair legs 7. In the preferred embodiment, the number of connecting legs is three for each shoulder-rocker foot combination. However, the shoulder and rocker feet may be connected by one or two legs, or by any combination of legs. The three leg embodiment shown in the Drawing Figures is meant as a means of illustration only and not as a limitation.

As best shown in FIG. 4, the front left and right rocker feet are connected together by means of a front rocker feet cross brace 8. The rear left and right rocker feet are connected together by a rear rocker feet cross brace 8'. Both the front and rear cross braces 8 and 8' connect the rocker feet together in a similar manner. In the preferred embodiment, the rocker feet have holes drilled therein and the cylindrical rocker feet cross braces are glued into the holes, thus connecting the rocker feet together.

The front left and right rocker feet are also connected together by means of a rocker feet glide brace 9. This rocker feet glide brace 9 connects front left and right rocker feet together as shown in the Drawing Figures. In the preferred embodiment, each rocker foot 5 has a hole drilled therein and the rocker feet glide brace 9 is inserted and glued into the holes on the respective feet. However, the rocker feet glide brace can connect the feet in any acceptable manner. The connection of wood pieces together is well known in the art. The rear rocker feet 5 are also connected together by a rocker feet glide brace 9'. This rear rocker feet glide brace 9' is best shown on FIG. 4.

In order to achieve the essentially horizontal gliding movement of the chair seat 1, the front and rear rockers 5 are connected together by means of a rocker feet glider brace connector 10. This connector is pivotably connected to the front 9 and rear 9' rocker feet glide braces. The preferred embodiment of the connector is an essentially rectangular glider brace 10 having a horizontal hole drilled through each end of the glider brace connector. Since the front 9 and rear 9' glider braces are connected at the same level from the bottom of the rockers, as shown in FIG. 1, the rocker feet glider brace connector 10 is essentially parallel to the floor surface 14, as best shown in FIG. 3.

The rocker shown in FIG. 1 also includes, in thee preferred embodiment, chair arms 12 and a chair arm support 13. The construction of the chair arms and support is well known in the art.

With a person sitting in the chair, one may easily move the chair seat forward in a smooth, horizontal motion by simply putting pressure on the chair seat in the forward direction. When that happens, the chair legs and shoulder rotate about the pivot point 4 and the rocker feet 5 rock forward. Since the front and rear rockers are connected together, the seat moves forwardly in a smooth, horizontal motion. Similarly, moving the seat backward moves the seat in that direction in a smooth, horizontal fashion.

It is important to this invention that the base 15 of the chair back 2, is placed slightly in front of the rear seat bracket hole 4. The main key to the even movement of the seat is the ratio of the forward placement of the back seat on the seat base, and the degree of back tilt. With the base of the chair back 15 located as shown, and with the back tilt of the chair back at approximately 75 degrees, the chair has even, smooth motion as the seat 1 moves forward or backward. The seat moves in a nearly parallel position with the floor surface 14.

In normal manufacture, the chair is made entirely of wood, with the exception of the seat bracket pivots 4' which can consist of a bolt and a nut. The chair legs 7, the front 8 and rear 8' cross braces and the front 9 and rear 9' glide braces are all connected by means of drilling and gluing. However, this attaching means can be varied and bolts, pins or other methods of attachment such as pressure fitting could also be utilized. While the preferred embodiment of this chair is made of wood for esthetic reasons, the chair could also easily be constructed of metal or a synthetic material while still keeping within the spirit and disclosure of this invention.

While the angle between the chair seat and back is approximately 75 degrees, this angle could be varied to as much as ±5 degrees while still keeping within the spirit and disclosure of this invention. Although the placement of the base of the chair back 15 with respect to the rear seat bracket pivot 4 is important, the base of the seat 15 could be placed slightly differently than as is shown in the Drawing Figures while still keeping within the spirit and disclosure of this invention.

Having fully described my invention, I claim:

1. A glider chair, comprising:

(a) a horizontal chair seat having front left and right and rear left and right shoulders pivotably attached to the bottom of said seat;

(b) corresponding front left and right and rear left and right arcuate rocker feet connected to said shoulders, respectively;

(c) front and rear crossbraces connecting the front left and right rocker feet and the rear left and right rocker feet, respectively;

(d) a rocker feet brace connector, pivotably connecting the front and rear crossbraces; and (e) a seat back, connected to the seat at an angle, wherein said seat back is connected to said seat at a location in front of the rear shoulder pivot.

2. A glider chair as in claim 1, wherein the angle between the seat and back is between 70 degrees and 80 degrees.

3. A glider chair as in claim 1, wherein the angle between the seat and back is 75 degrees.

* * * * *